US005704485A

United States Patent [19]

Cautereels et al.

[11] Patent Number: 5,704,485

[45] Date of Patent: Jan. 6, 1998

[54] FOOD CONTAINER WITH COOLING PACK

[75] Inventors: Victor J. J. Cautereels, Borsbeek, Belgium; Ian Ferris, Berkshire; John Tree, London, both of England

[73] Assignee: Dart Industries Inc., Orlando, Fla.

[21] Appl. No.: 528,786

[22] Filed: Sep. 28, 1995

[51] Int. Cl.[6] ..... B65D 81/24

[52] U.S. Cl. ..... 206/546; 62/371; 62/457.1; 62/530; 206/541; 206/557; 220/23.83; 220/608

[58] Field of Search ..... 62/371, 372, 457.1, 62/457.6, 457.7, 457.8, 457.9, 459, 529, 530; 206/514, 541, 542, 545, 546, 549, 804, 815, 557; 220/23.83, 306, 410, 574, 575, 608, 669, 670, 672–674

[56] References Cited

U.S. PATENT DOCUMENTS

| | | | |
|---|---|---|---|
| D. 253,331 | 11/1979 | Olschewski . | |
| D. 282,808 | 3/1986 | Daenen et al. . | |
| D. 291,041 | 7/1987 | Grange . | |
| D. 298,199 | 10/1988 | Finsilver et al. . | |
| D. 308,941 | 7/1990 | Kong . | |
| D. 312,968 | 12/1990 | Wolff . | |
| D. 325,847 | 5/1992 | Wolff . | |
| 2,496,296 | 2/1950 | Lobl | 62/530 |
| 3,255,607 | 6/1966 | Bair et al. | 206/545 |
| 3,384,263 | 5/1968 | Bernstein . | |
| 3,958,359 | 5/1976 | Doughty . | |
| 4,091,953 | 5/1978 | Daenen . | |
| 4,336,883 | 6/1982 | Krug et al. . | |
| 4,412,630 | 11/1983 | Daenen . | |
| 4,441,336 | 4/1984 | Cannon | 62/371 |
| 4,491,219 | 1/1985 | Lutz . | |
| 4,499,998 | 2/1985 | Carlson . | |
| 4,765,506 | 8/1988 | Fishmann et al. . | |
| 4,771,907 | 9/1988 | Torney . | |
| 4,908,248 | 3/1990 | Nakashima et al. | 62/530 |
| 5,011,013 | 4/1991 | Meisner et al. . | |
| 5,012,928 | 5/1991 | Proffitt et al. | 220/306 |
| 5,353,935 | 10/1994 | Yeager et al. | 206/815 |
| 5,390,797 | 2/1995 | Samlley et al. . | |
| 5,423,453 | 6/1995 | Fritz | 220/608 |
| 5,441,707 | 8/1995 | Lewis et al. | 206/514 |
| 5,522,239 | 6/1996 | Schwartz et al. | 62/530 |
| 5,538,136 | 7/1996 | Onneweer | 206/815 |

FOREIGN PATENT DOCUMENTS

| | | | |
|---|---|---|---|
| 39317 | 11/1981 | European Pat. Off. | 62/530 |
| 330473 | 8/1989 | European Pat. Off. | 220/23.83 |

*Primary Examiner*—Jimmy G. Foster
*Attorney, Agent, or Firm*—John A. Doninger

[57] ABSTRACT

A food container and assemblage of internal components including a tray with a corrugated and slotted bottom panel supported within the container receptacle, and a cooling pack positioned within the container in a variety of positions to define food chambers wherein the food is maintained out of contact with the cooling pack.

16 Claims, 6 Drawing Sheets

FOOD CONTAINER WITH COOLING PACK

BACKGROUND OF THE INVENTION

Food containers for the temporary storage and transport of foodstuffs, the most common example being the conventional lunchbox, are well known. Such containers take many forms and may include internal partitions, removable receptacles, and/or internal or external cooling means.

For convenience in handling, effective sealing, attractive appearance, and the like, the preferred material for such containers for pre-prepared lunches or dinners is an appropriate synthetic resinous material which is food compatible, shape sustaining and incorporates a degree of resilient flexibility, primarily for use in mounting and removing the seal from the receptacle or bowl.

SUMMARY OF THE INVENTION

The present invention, also utilizing an appropriate food compatible synthetic resinous material, is basically an assemblage of cooperating components including a container having a receptacle and a seal peripherally engaged with and releasably secured to the receptacle, an internal invertible support tray, and a cooling pack. Depending upon the height of the receptacle and/or seal, the assemblage can also include a separate closable container or box removably received within the main container and forming a food-segregating compartment therein.

The various components cooperatively interrelate to provide a desirable varying of the arrangement of the internal space within the container for maximum efficiency in the storing of a variety of foodstuffs, and a choice in the location of the cooling pack in accordance with the nature of the foodstuffs and the cooling effect desired.

The components are also configured to allow easy access to the interior of the container and ready removal and rearrangement of those components within the container.

Other objects of the invention include means to minimize internal condensation within the container and moisture absorption by the food.

In achieving the goals of the invention, the container receptacle includes peripheral walls rising from a generally rectangular base and including a series of ribs forming inwardly directed steps toward an upper flange-defining rim. Opposed end walls of the receptacle include upwardly and inwardly opening arcuate recesses. The actual height of the receptacle may vary, preferably by increasing or decreasing the height of the walls between the bottom panel and the upper ribs.

The seal includes a top panel with depending continuous opposed side and end walls which snap engage beneath the outer edge portions of the receptacle flange, or beads formed thereon. The seal may be of a low profile, thus minimizing the height of the container. Alternatively, the seal can be of a relatively substantial height wherein peripheral seal walls, with ribs generally in the manner of the receptacle walls, provide additional usable interior space.

An internal removable tray is provided to vertically partition the container into overlying and underlying compartments, principally to maintain the cooling pack out of direct engagement with the food. In addition, the tray, which is invertible within the container and similarly edge supported on an internal receptacle ledge or step in either position thereof, provides for an accommodation of either the cooling pack or the food in a variety of vertical relationships both relative to each other and relative to the interior of the container. For easy positioning and removal, the opposed ends of the tray includes central recessed portions which align with concave recesses within the end walls of the container receptacle to allow for easy passage of the fingers to grasp the opposed ends of the tray with or without articles supported thereon. In addition, the base panel of the tray includes low corrugations on a generally transverse arcuate path repeated generally throughout the length of the tray base. The corrugations, in the valley portions thereof, include slots which allow for air flow therethrough and a minimization of the buildup of condensate, whether the tray be used to support the cooling pack or the food.

The cooling pack, of a size as to fit within the tray, is also provided with transverse corrugations completely thereabout, thus providing a greater surface area for an enhanced cooling effect. In addition, the corrugations, whether the pack is supported within the tray or on the bottom panel of the receptacle, allow for air circulation, reducing the buildup of condensate and providing for a more effective transfer of the cooling effect of the pack. For ease of placing and removal, the cooling pack includes a pair of vertical apertures defined centrally therethrough and slightly spaced from each other. Thus, the user can insert the thumb and index finger of the hand within the apertures and easily remove the pack.

The assemblage will also preferably include a separate compartment-defining box including a removable seal. The box will necessitate an outer container of sufficient height to include the tray, in at least one of the two positions thereof, as well as the box itself. Thus, the container will normally incorporate a higher seal, although provision can also be made for the box by the use of a receptacle with slightly higher walls.

Other features, objects and advantages will become apparent from the more detailed description of the invention following hereinafter.

DESCRIPTION OF PREFERRED EMBODIMENTS

Figure 1:
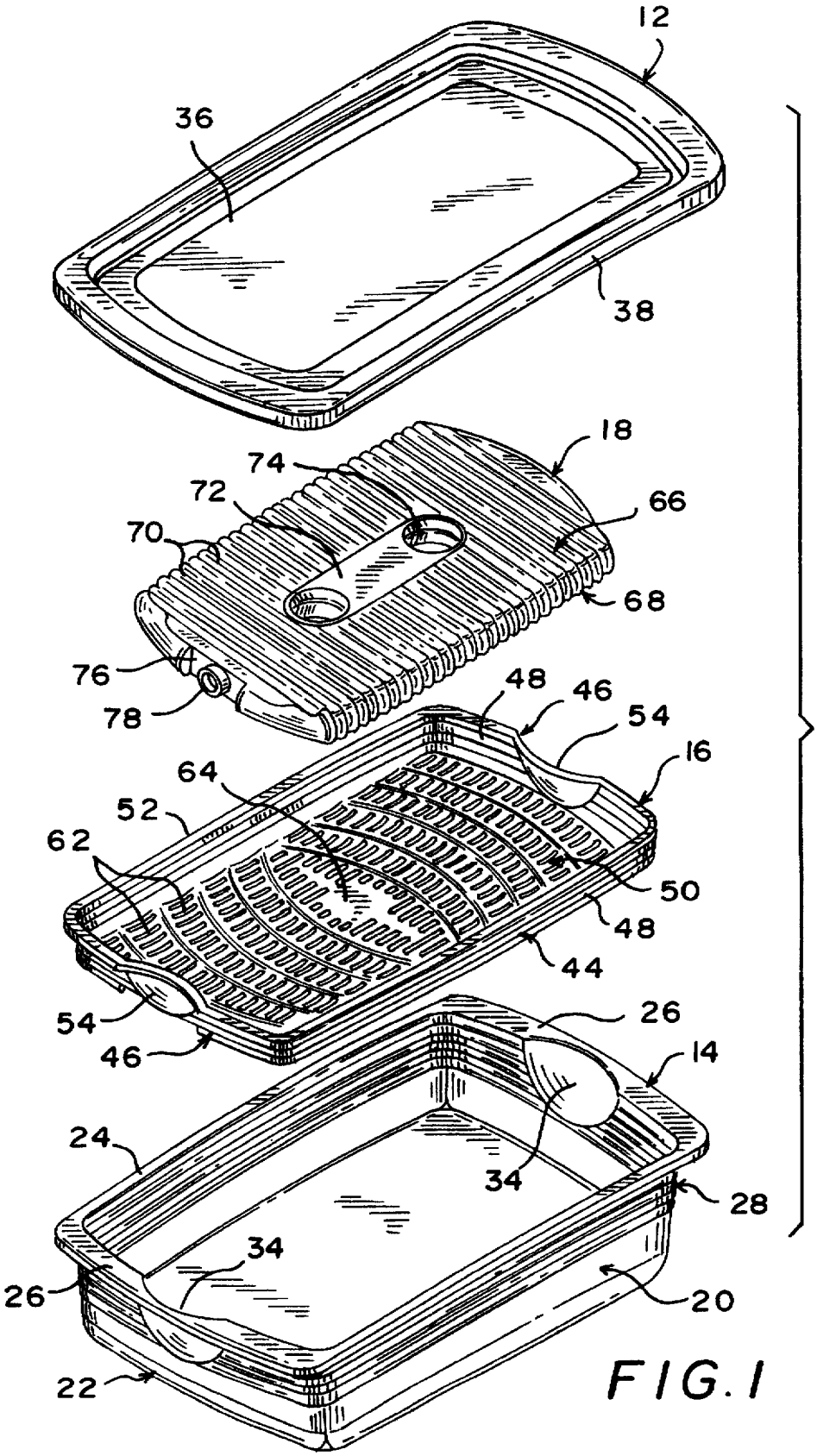
FIG. 1 is an exploded perspective view of the components which define the container and the assemblage including the container and container-received items.

Referring now more specifically to the drawings, and in particular FIGS. 1–4, the container 10 is illustrated with a low or generally planar seal 12 and a receptacle 14 of a depth to accommodate an internal tray 16 and an ice or cooling pack 18. The tray is positionable within the interior of the container to provide vertically separated compartments extending the full length of the container and of a size as to receive the cooling pack 18 and foodstuffs separated therefrom.

The receptacle 10 is preferably of a generally elongate rectangular configuration with rounded corners and upright walls continuously thereabout and defining a pair of opposed end walls 22 and a pair of opposed side walls 20.

The side walls each include an integral full length outwardly directed upper handling flange 24. Similar although wider upper edge handling flanges 26 are integrally formed with the end walls 22. The flanges 24 and 26 are integrally joined at the corners and define a continuous planar surface about the periphery of the container receptacle 14.

The side and end walls, for a substantial portion of the height thereof immediately below the corresponding flanges, include substantially continuous longitudinally extending horizontal ribs 28. These ribs, on the interior of the receptacle walls, define a series of upwardly directed steps 30 which follow a slight outward tapering which generally corresponds to the slight upward and outward tapering of the walls 20 and 22 themselves. A similar series of downwardly directed outer shoulders 32 are also defined by the ribs 28.

In order to facilitate handling of the receptacle 14, as well as the introduction and removal of the internal tray and cooling pack, the opposed end walls 22 have integrally formed gripping and finger-access recesses 34. Each recess 34 is formed by a slight outward protuberance in the end wall with a concave inwardly directed configuration which also opens through the end wall flange 26 immediately thereabove. As noted in the drawings, the ribs 28 are discontinuous at the formed recesses 34. With the recesses 34 so formed, one can easily slide ones fingers into the receptacle and engage the internal components for removal from the receptacle. Similarly, the recesses 34 allow for a more positive gripping of the opposed end walls without interference from the mounted tray 16 or the like.

The seal 12 is of a general planar configuration with an elongate rectangular top panel 36, the major portion of which is slightly depressed, and a peripheral depending flange 38 with an inwardly directed bead 40 which snap locks beneath the outer peripheral edge of the continuous receptacle flanges 24 and 26. The receptacle flanges also may have a depending bead or lip 42 defined thereon. As will be appreciated, the seal 12 is coextensive with the flanged upper end of the receptacle 14 and intimately seats on the upper flanges 24 and 26 to provide tight engagement therewith as the edge bead 40 of the seal 12 engages beneath the flanges 24 and 26. So positioned, it will also be appreciated that the upwardly opening gripping recesses 36 are effectively sealed by the mounted seal 12.

As will be referred to more specifically with regard to a second embodiment, the opposed end corners of the seal 12 can be provided with integral extending lifting tabs to facilitate separation of the seal 12 from the receptacle 14.

The tray 16, receivable within the receptacle 14, includes an outer periphery generally conforming to that of the interior of the receptacle 14, including substantial straight opposed side walls 44 and slightly arcuate end walls 46. These walls include stepped ribs 48, similar to the ribs 28, substantially continuously thereabout and for the full height thereof. The walls 44 and 46 extend integrally upward from a base panel 50 and terminate in a continuous outwardly extending rim-forming flange 52. The ribs 48 are interrupted at the central portion of the tray end walls 46 by inwardly convex gripping portions 54 forming outwardly directed recesses which, upon a positioning of the tray 16, align with the receptacle recesses 34, provide an enlarge space or pocket to facilitate manual access to the tray 16 for positioning and removal.

Figure 11:
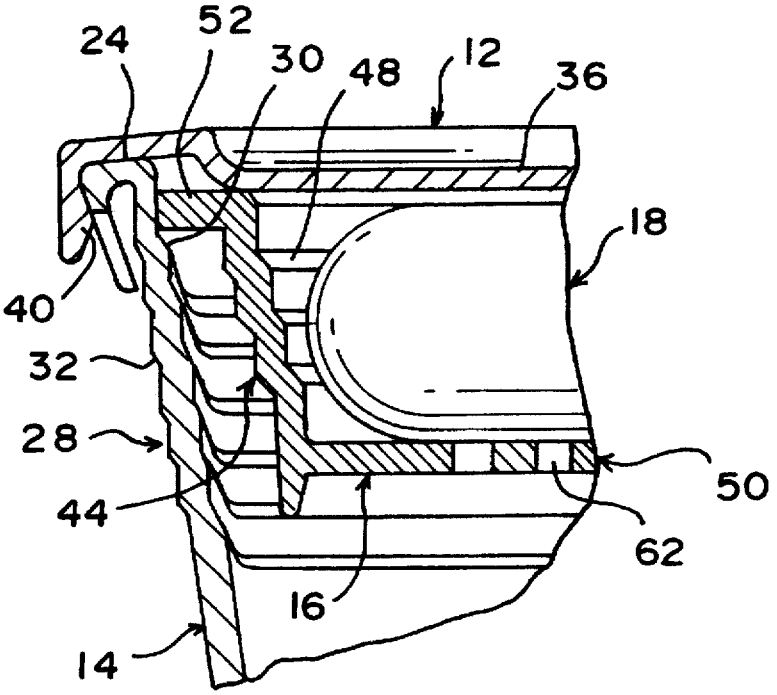
FIG. 11 is a cross-sectional detail illustrating one manner of engaging the tray flange with the receptacle walls in a supported position.
Figure 12:
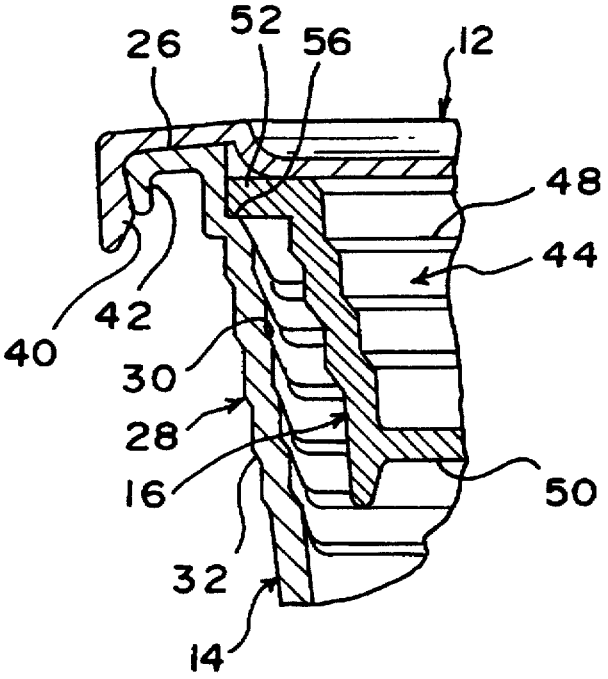
FIG. 12 is a cross-sectional detail illustrating another manner of supporting the tray flange.

The tray is of a depth approximately one-half of that the receptacle 14, as illustrated in FIGS. 1–4, and is supported within the receptacle, in a suspended position immediately below the upper rim flanges of the receptacle 14, by an engagement of the upper tray flange 52 either with the upper step 30 of the receptacle ribs 28, as shown in FIG. 11, or on a specifically defined shoulder 56 provided immediately above the ribs 28, as in FIG. 12.

The base panel 50 of the tray 16 is formed with a series of corrugations of alternating ridges 58 and valleys 60 in the longitudinal direction of the panel 50 and individually extending, along a slightly arcing path, transversely across the tray panel. The corrugated configuration is defined both on the inner and outer faces of the tray panel 50. In addition, the upwardly directed valleys 60 include a series of transversely aligned and longitudinally extending slots 62 defined through the panel to enhance circulation of air in the closed container. Such a circulation of air is also enhanced by the corrugated configuration of the tray panel 50 which provides for support of foodstuffs and the cooling pack with a free flow of air thereabout. This is considered significant in reducing condensate, maintaining the desired cooling effect, and reducing the possibility of moisture absorption into the food.

Noting the tray as illustrated in FIG. 1, it will be seen that the transverse arcing of the corrugations is oppositely directed to the opposed end portions of the tray between the end walls 46 thereof and a generally planar central portion 64 also provided with apertures or slots therein similar to the slots 62.

Figure 2:
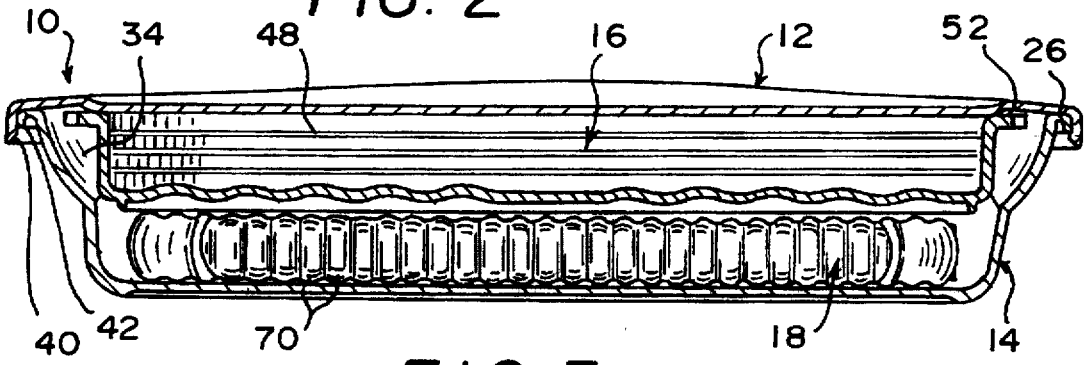
FIG. 2 is a longitudinal cross-sectional view through the closed container with the ice pack supported on the base of the receptacle and the tray suspended thereover.
Figure 3:
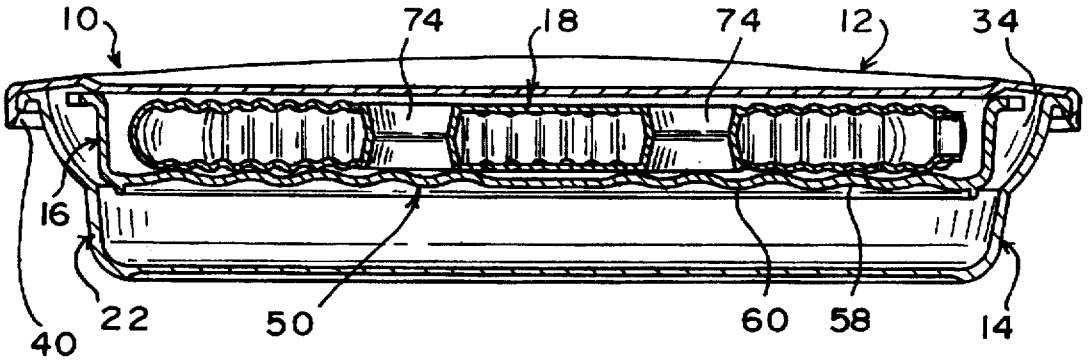
FIG. 3 is a cross-sectional view similar to FIG. 2 with the cooling pack supported within the tray.
Figure 4:
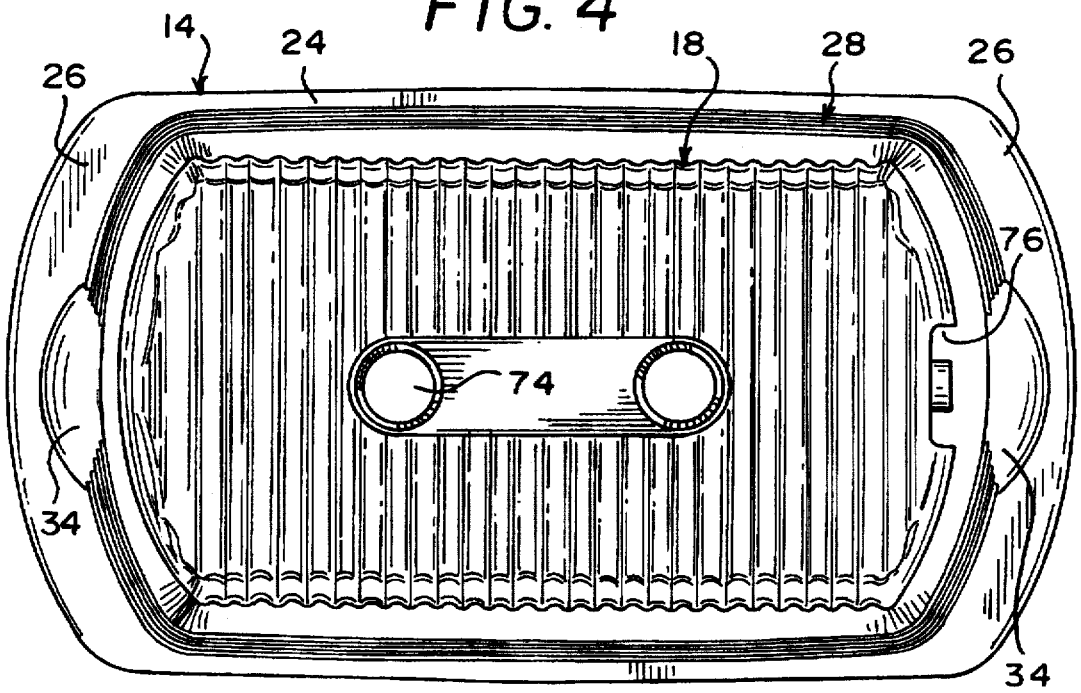
FIG. 4 is a top plan view of FIG. 2 with the seal and tray removed.

The cooling pack 18 has an outer periphery which, while generally corresponding to the configuration of the interior of the receptacle 14, is of a size as to be freely although closely received either within the bottom portion of the receptacle 14, as illustrated in FIG. 2, or within the upwardly opening tray 16, as illustrated in FIG. 3.

The cooling pack 18 is a relatively flat container with a freezing medium therein, the pack being normally permanently sealed and repeatedly frozen as desired, for example in a home freezer. The upper and lower panels 66, as well as the longitudinally extending side walls 68, are formed with transversely extending corrugations 70 or alternate valleys and ridges completely thereabout and for substantially the full longitudinal extent of the cooling pack 18. These corrugations 70 are only interrupted by a longitudinally elongate planar central portion 72 on each panel terminating in a pair of longitudinally spaced finger holes 74 which provide for an easy grasping of the cooling pack 18 for placement and removal. It will also be noted that one of the end walls of the cooling pack has a recess 76 defined therein, providing a protective partial enclosure for a filling port 78 through which the freezing medium within the pack 14 will initially be introduced. This recess may also be used to facilitate a removal of the pack.

The corrugated configuration of the body of the freezing pack 18 is significant in providing multiple airflow paths about the pack and minimizing direct surface to surface contact with the bottom panel of the receptacle or the base panel of the tray as might limit the overall cooling effect. The corrugations are also significant in providing an increase of the exposed surface area for greater cooling transfer, and a greater accommodation of condensation build-up.

Figure 5:
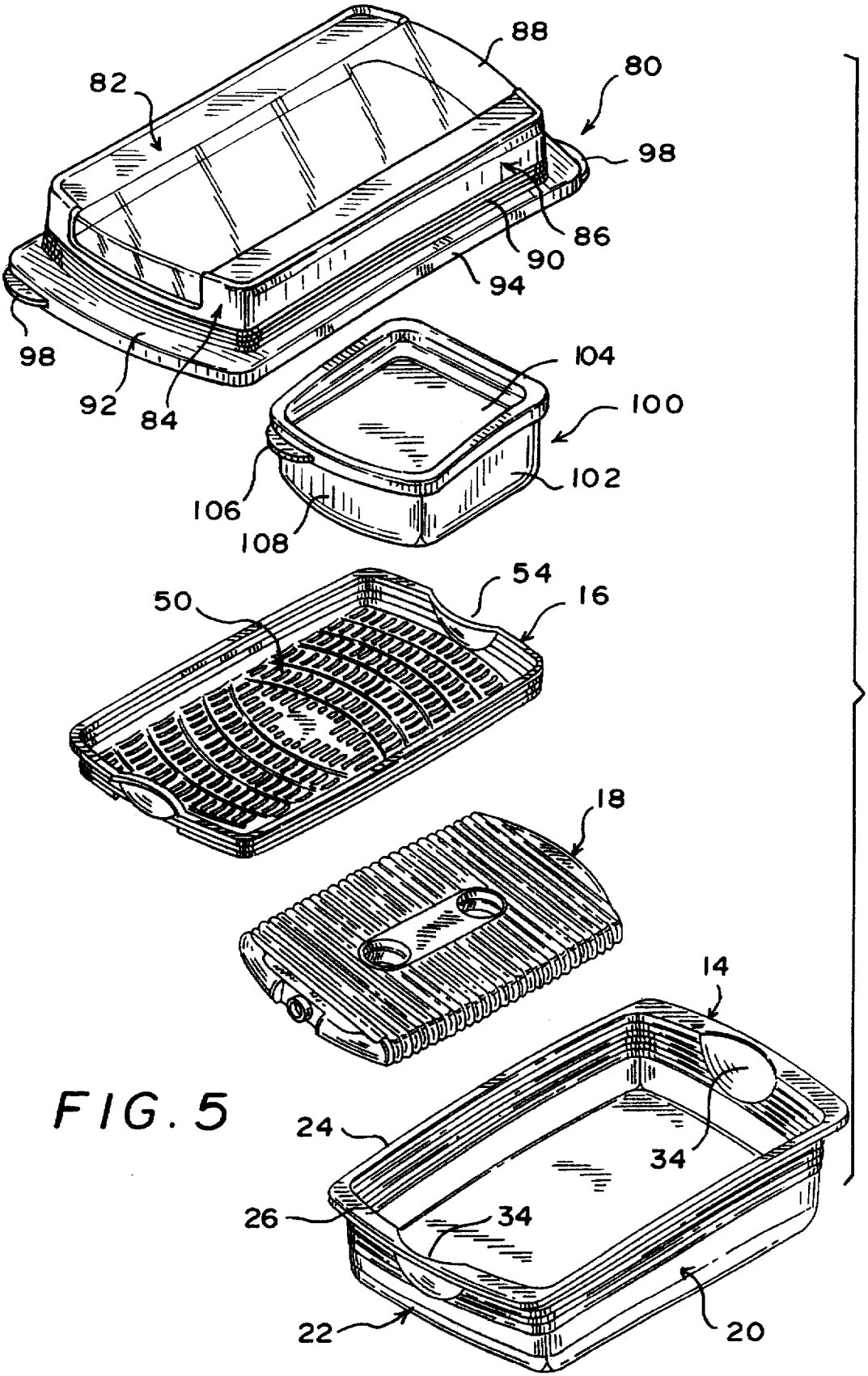
FIG. 5 is an exploded perspective view of a variation incorporating a substantially higher seal and a removable internal food box.
Figure 6:
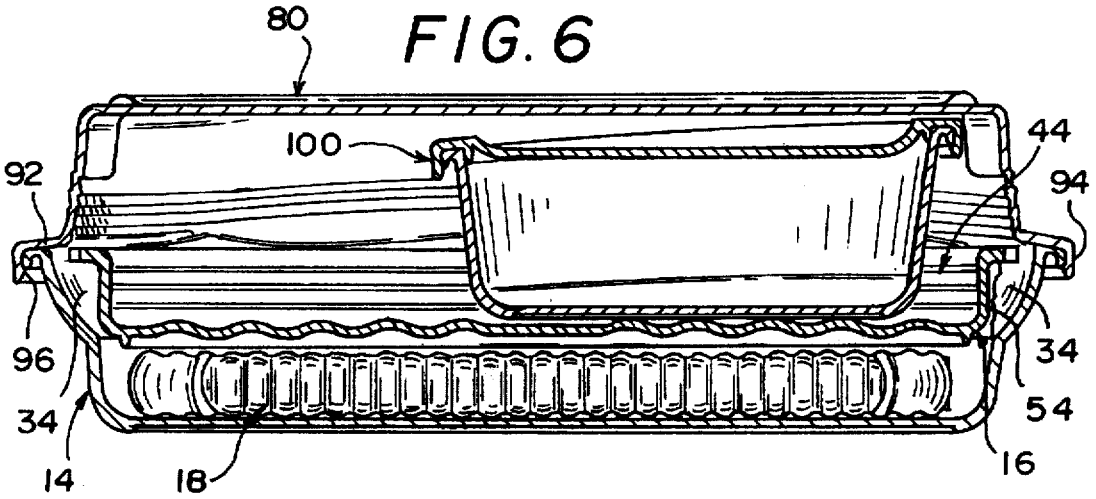
FIG. 6 is a longitudinal cross-sectional view of the assembled components of FIG. 5 with the tray upwardly opening and supporting the box thereon over the cooling pack on the bottom panel of the receptacle.
Figure 7:
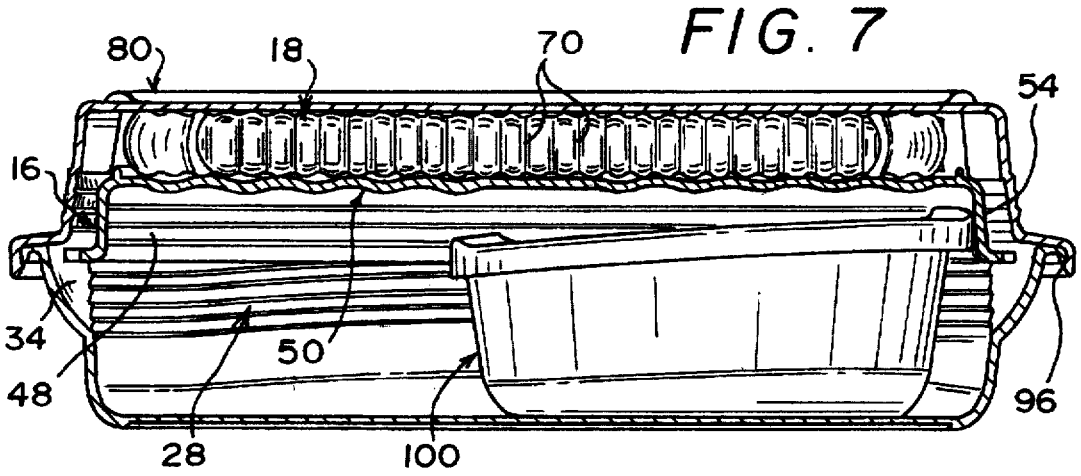
FIG. 7 is a similar longitudinal cross-sectional view with the tray inverted and supporting the cooling pack adjacent the top panel of the seal, the smaller internal box being below the tray.

Turning now to FIGS. 5, 6 and 7, the embodiment of the invention illustrated therein differs from that initially described by utilizing a high seal 80, that is a seal of substantially greater height than the originally described seal 12.

The seal 80 includes a top panel 82, opposed end walls 84 and opposed side walls 86. The top panel 82 and opposed end walls 84 include a longitudinal extending slightly recessed continuous translucent or transparent portion 88. Both the end and side walls 84 and 86 are provided with a continuous series of stepped ribs 90 integrally formed therein completely about the walls, similar to the stepped ribs 28 of the receptacle 14 and for a height of no greater than one-half the height of the walls 84 and 86.

Immediately below the ribbed portions of the walls 84 and 86, the seal 80 is provided with an integral outwardly extending continuous flange 92 which terminates in a depending locking flange 94 with an inwardly directed bead 96 thereon for snap locking beneath the outer edge portion of the receptacle flange 26 in the same manner as the locking bead 40 on the previously described low seal 12. The positioning of the locking bead 96 is such as to bring the seal flange 92 in intimate engagement with the top surface of the flange 26 of the receptacle 14. In order to facilitate removal of the seal 80, integral longitudinally extending lifting tabs 98 can be provided at two or more end wall corners.

The height of the seal 80 is significant in that, noting FIG. 6 and 7, the interior of the container 10 is sufficiently enlarged as to accommodate a separate internal container or box 100, as well as the tray 16 in either its upwardly opening position, shown in FIG. 6, or in an inverted downwardly opening position as in FIG. 7. The tray 16, in either position, will have the peripheral flange edge thereof supported either on the upper rib step or on a specifically defined shoulder, and will allow the positioning of the cooling pack either above or below the food receiving chamber in accordance with the nature of the food to obtain the maximum cooling benefit while minimizing moisture build-up within the food.

The internal box 100 is of a size as to require only a portion of the main food chamber whereby different segregated foodstuffs can be provided. The box 100 is in itself a self contained sealed container with a generally rectangular receptacle 102 and a removable seal 104 having a peripheral snap-mounting flange portion and, preferably, a projecting tab 106 to facilitate removal.

The box 100, while of a generally rectangular configuration, includes an arcuate end wall 108 which can, to a degree, accommodate itself to the generally arcuate end wall of the receptacle or seal. In addition, the receptacle 102 of the box has a slightly inclined longitudinal upper edge with a similar inclination in the peripheral edge flange of the box seal 104. The top panel of the box seal 104, noting the cross-section of FIG. 6, will be retained horizontal, that is substantially parallel to the base of the receptacle 102, thus facilitating stacking.

Figure 8:
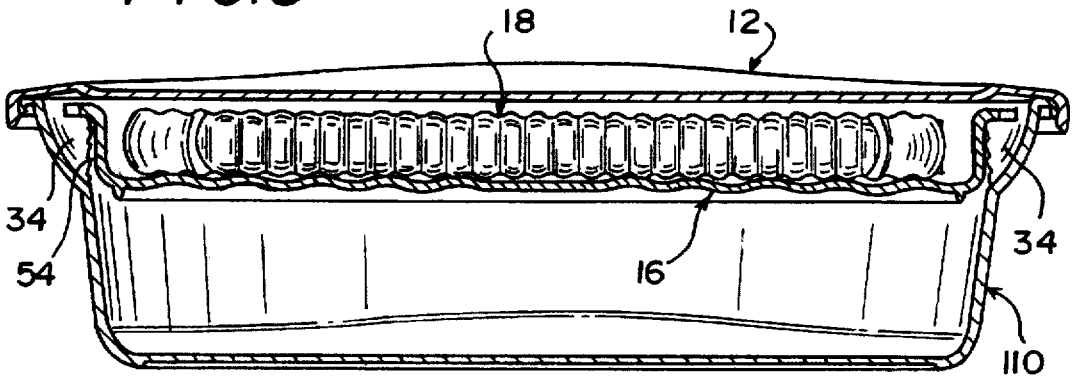
FIG. 8 is a similar longitudinal cross-sectional view with a low profile seal and a high profile receptacle wherein the tray is upwardly opening and receives the cooling pack.

FIG. 8 illustrates a further variation wherein the receptacle 110 is vertically enlarged relative to the previously described receptacle 14. The height increase is provided by a vertical extension of the portion of the receptacle walls below the upper formed ribs, and allows for an increased internal storage space even when using the low seal 12. In this variation, it is preferred that the cooling pack 18 be supported within the upwardly opening tray 16.

Figure 9:
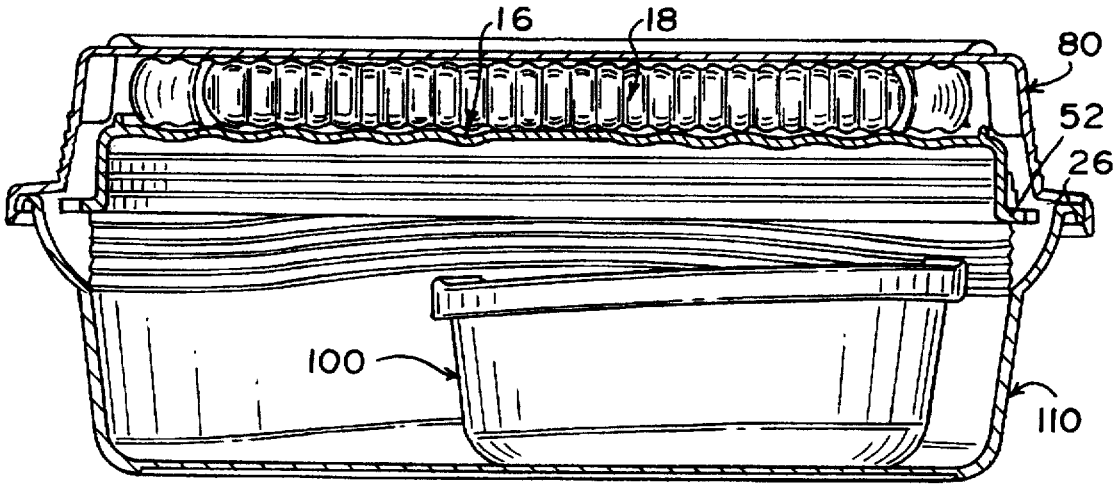
FIG. 9 is a longitudinal cross-sectional view similar to FIG. 7 wherein the height of the receptacle is further increased, primarily in the walls below the stepped upper wall portions.
Figure 10:
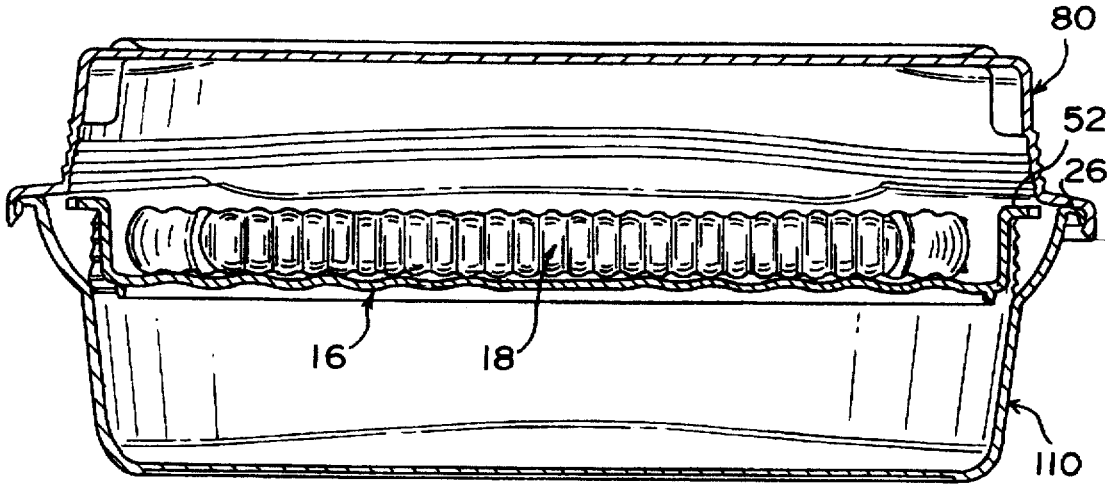
FIG. 10 is a cross-sectional view similar to FIG. 9 with the tray upwardly opening and supporting the cooling pack, the internal heights of both the receptacle and seal providing storage space above and below the cooling pack.
Figure 13:
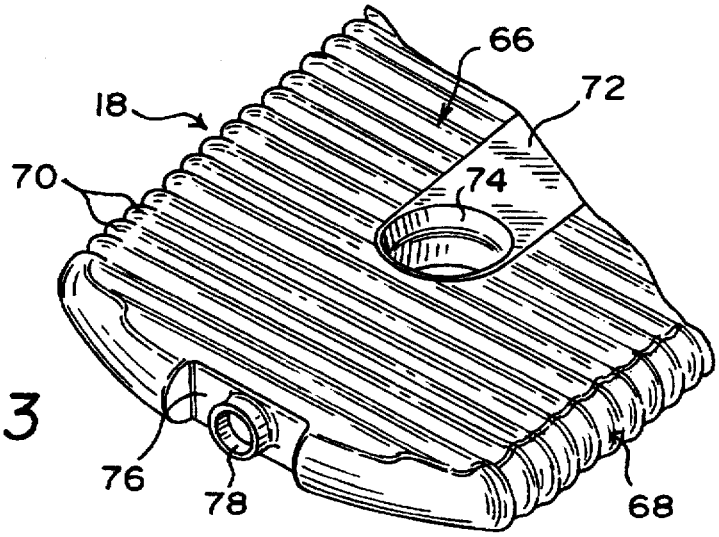
FIG. 13 is a perspective detail of the cooling pack.

FIGS. 9 and 10 illustrate the higher receptacle 110 with the high seal 80, thereby providing a maximum interior space and allowing for substantially variation in the positioning of the cooling pack 18, the orientation of the interior container or box 100, and the positioning of the tray 16, that is either upwardly directed or downwardly directed.

The described assemblage is unique in providing for maximum cooling within a food container incorporating a separate cooling pack. This is done by limiting direct contact between the food and the cooling pack, thus reducing the tendency for direct moisture transfer to the food. In addition, through the specifically configured internal support tray, and the configuration of the cooling pack itself, maximum air flow and cooling surfaces are provided. Provision is also made for a separate internal food box. It should also be recognized that, with the arrangement of FIG. 6, the container can be used as a cooled serving dish by merely removing the seal, thus exposing the upwardly directed tray with foods thereon and with the cooling pack concealed therebelow yet effectively communicated with the supported foods.

In order to achieve maximum space utilization, the tray and cooling pack are configured for close reception within the container receptacle. At the same time, specific provision is made for an easy grasping and removal from the receptacle, as well as a handling of the receptacle itself through cooperating finger-receiving recesses and handles.

The foregoing is considered illustrative of the features of the invention, and the illustrated embodiments and varying arrangements are not to be considered as limitations on the scope of the invention as set forth in the claims following hereinafter.

We claim:

1. A container assembly comprising an elongate generally rectangular upwardly opening receptacle having a bottom panel, peripheral walls, including a pair of opposed end walls, extending upward from said bottom panel to upper wall edges, and an outwardly directed flange integral with and continuously along said upper wall edges, a pair of opposed access recesses, one defined in and opening inwardly relative to each of said end walls generally centrally thereof, each of said recesses also being defined in and opening upwardly through said receptacle flange for direct downward access thereto; and an overlying seal substantially co-extensive with said receptacle and including a peripheral downwardly directed flange-engaging projection with means thereon for releasably snap-locking to said receptacle flange; and a tray having a base panel, wall means integral with said base panel and extending therefrom peripherally thereabout, and peripheral flange means integral with said tray wall means and extending laterally outward therefrom, said tray having a peripheral configuration closely conforming to and engageable within said receptacle below said receptacle flange, and support means on said peripheral walls of said receptacle receiving said tray flange means for support of said tray within said receptacle, said tray peripheral wall means including a pair of opposed end walls corresponding to said end walls of said receptacle, said tray end walls including inwardly arcing portions therein extending from said tray flange means and aligned with said receptacle end wall recesses to combine therewith in defining an access pocket for manual engagement with said tray.

2. The container assembly of claim 1 wherein said tray base panel is provided with a series of transverse corrugations extending the length of said base panel between said tray end walls and defining multiple lines of alternating supports and spaces along the length of said tray.

3. The container assembly of claim 2 wherein said tray base panel corrugations define alternating series of upwardly directed ridges and valleys, each of said valleys having a series of openings therealong defined through said base panel.

4. The container assembly of claim 3 wherein said alternating ridges and valleys extend along transverse arcs across said base panel.

5. The container assembly of claim 4 wherein said tray, supported within said receptacle, is invertible to a position extending above said receptacle flange with said tray base panel uppermost.

6. The container assembly of claim 5 including a cooling pack receivable within the receptacle and seal thereover, said cooling pack being generally flat and having a peripheral configuration approximating that of the receptacle and dimensioned for removable reception within said tray, said cooling pack having an outer surface defined by a series of corrugations continuously transversely thereabout and defining alternating ridges and valleys wherein the ridges define support portions engagable with an underlying surface and with the valleys defining air flow passages.

7. The container assembly of claim 6 wherein said cooling pack has a pair of spaced finger-holes defined therethrough for finger engagement with and manipulation of said cooling pack.

8. The container assembly of claim 1 wherein said tray, supported within said receptacle, is invertible to a position extending above said receptacle peripheral flange with said tray base panel uppermost.

9. The container assembly of claim 8 wherein said seal includes a top panel with an integral peripheral depending wall terminating in a peripheral outwardly directed seal flange, said peripheral seal flange terminating in said peripheral downwardly directed flange-engaging projection, said peripheral seal wall being of a height generally equal to combine height of said tray wall means and said cooling pack.

10. The container assembly of claim 9 wherein said tray is inverted in said receptacle with said tray base panel uppermost and within said seal, said cooling pack overlying said tray panel within said seal.

11. The container assembly of claim 9 wherein said tray divides said receptacle and seal into overlying and underlying compartments, said cooling pack being received within one of said compartments, and a closable container for foodstuffs received in the other of said compartments, said tray segregating the cooling pack and food receiving container from and out of contact with each other.

12. The container assembly of claim 1 wherein said receptacle peripheral walls have a plurality of peripheral ribs defined therein adjacent said upper wall edges, said ribs defining at least one internal step for receiving said tray flange means and comprising said support means for the support of said tray within said receptacle.

13. The container assembly of claim 1 wherein said receptacle peripheral walls have an internal shoulder defined therein at least partially therealong and comprising said support means for supporting engagement of said tray peripheral flange means thereon.

14. A tray receivable within a food container for internally dividing said container into separate compartments, said tray having a base panel, peripheral walls integral with said base panel, said base panel having a length and a transverse width, a series of corrugations extending along arcs transversely across said panel for at least a major portion of the length of said panel, said corrugations defining alternating arcing ridges and valleys, each of said valleys having a series of openings defined therein and through said panel, said ridges defining spaced arcing supports for items received in said tray.

15. A cooling pack for use within a food container assembly, said cooling pack being of a substantially flat elongate configuration with an upper panel and a spaced lower panel, longitudinally extending side walls and transversely extending end walls surrounding and integrally joined to said upper and lower panels, transverse corrugations formed in said upper and lower panels and said side walls and extending peripherally about said pack for substantially the full length of said pack wherein a series of alternating ridges and valleys are defined completely about the pack to avoid intimate contact of said pack with the container assembly and to provide for airflow passages completely about said pack, and a single pair of spaced openings defined through said pack and said upper and lower panels thereof, said openings being centrally positioned in said pack inward of said side and end walls and being of a size to accommodate fingers of a hand for manipulation of said cooling pack.

16. A container assembly comprising a generally rectangular upwardly opening receptacle having a bottom panel, peripheral walls, including a pair of opposed end walls, extending upward from said bottom panel to upper wall edges, and an outwardly directed flange integral with and extending along said upper wall edges, a pair of opposed access recesses, one defined in and opening inwardly relative to each of said end walls generally centrally thereof, each of said recesses also being defined in and opening upwardly through said receptacle flange for direct downward access thereto; and a tray having a base panel, wall means integral with said base panel and extending therefrom peripherally thereabout, and peripheral flange means integral with said tray wall means and extending laterally outward therefrom, said tray having a peripheral configuration closely conforming to and engageable within said receptacle below said receptacle flange, and support means on said peripheral walls of said receptacle receiving said tray flange means for support of said tray within said receptacle, said tray peripheral wall means including a pair of opposed end walls corresponding to said end walls of said receptacle, said tray end walls including outwardly directed recessed portions therein extending from said tray flange means and aligned with said receptacle end wall recesses to combine therewith in defining an access pocket for manual engagement with said tray.

* * * * *